US005813062A

United States Patent [19]

Vago et al.

[11] Patent Number: 5,813,062

[45] Date of Patent: Sep. 29, 1998

[54] SIDE ENTRY BATHTUB

[75] Inventors: Robert Edward Vago, Northbrook, Ill.; Dale Owen Carmine, York, Nebr.

[73] Assignee: Arjo USA, INC., Aurora, Nebr.

[21] Appl. No.: 471,565

[22] Filed: Jun. 6, 1995

Related U.S. Application Data

[63] Continuation of Ser. No. 178,938, Jan. 7, 1994, abandoned.

[51] Int. Cl.[6] ..... A47K 3/02

[52] U.S. Cl. ..... 4/556; 4/560.1

[58] Field of Search ..... 4/540, 555, 556, 4/560.1, 561.1, 562.1, 563.1, 564.1, 565.1, 566.1, 604

[56] References Cited

U.S. PATENT DOCUMENTS

| | | | |
|---|---|---|---|
| D. 297,161 | 8/1988 | Weschta | D23/279 |
| 2,514,848 | 7/1950 | Davis | 4/540 |
| 2,536,540 | 1/1951 | Davis | 4/540 |
| 2,697,475 | 12/1954 | Dueth | 4/566.1 |
| 3,104,399 | 9/1963 | Dalton | 4/562.1 |
| 3,174,160 | 3/1965 | Fielding | 4/540 |
| 3,562,821 | 2/1971 | Queen | 4/604 |
| 3,604,018 | 9/1971 | Moran | 4/556 |
| 3,641,596 | 2/1972 | Bill | 4/540 |
| 3,662,409 | 5/1972 | Johansson | 4/560.1 |
| 3,703,733 | 11/1972 | McLoughlin | 4/556 |
| 3,714,672 | 2/1973 | Condon | 4/563.1 |
| 3,852,835 | 12/1974 | Whitaker | 4/562.1 |
| 3,918,108 | 11/1975 | Feyerherm | 4/563.1 |
| 3,924,278 | 12/1975 | Ekman | 4/540 |
| 4,099,272 | 7/1978 | Sowder | 4/555 |
| 4,128,904 | 12/1978 | Ekman et al. | 4/540 |
| 4,160,292 | 7/1979 | Kuether et al. | 4/604 X |
| 4,202,060 | 5/1980 | Touze | 4/556 |
| 4,280,234 | 7/1981 | Sax | 4/540 |
| 4,296,508 | 10/1981 | Moran | 4/540 |
| 4,530,121 | 7/1985 | Penney | 4/540 |
| 4,592,099 | 6/1986 | Zellner | 4/540 |
| 4,733,418 | 3/1988 | Luther | 4/562.1 |
| 4,888,834 | 12/1989 | Vago | 4/540 |
| 5,163,187 | 11/1992 | Dannenberg et al. | 4/556 |
| 5,184,358 | 2/1993 | Gruidel et al. | 4/555 |
| 5,195,192 | 3/1993 | Garde | 4/585 |
| 5,220,696 | 6/1993 | Dannenberg et al. | 4/556 |
| 5,255,400 | 10/1993 | Sween | 4/556 |

FOREIGN PATENT DOCUMENTS

| | | |
|---|---|---|
| 0 008 515 | 3/1980 | European Pat. Off. . |
| 0 581 356 | 2/1994 | European Pat. Off. . |
| 0 585 564 | 3/1994 | European Pat. Off. . |
| 1 220 710 | 1/1971 | United Kingdom . |
| 1 226 206 | 3/1971 | United Kingdom . |
| 1 299 165 | 12/1972 | United Kingdom . |
| 2 029 211 | 3/1980 | United Kingdom . |
| 2 036 606 | 7/1980 | United Kingdom . |
| 94/07403 | 4/1994 | WIPO . |

*Primary Examiner*—Robert M. Fetsuga
*Attorney, Agent, or Firm*—McDermott, Will & Emery

[57] ABSTRACT

A side entry tub includes a stationary section and a movable section with a mechanism of pivoting the movable section away from the stationary section to form an opening for entry and back to the stationary section to form an enclosure for bathing. During pivoting, the movable portion is separated from the stationary section to avoid damage and excessive wear on sealing gaskets.

7 Claims, 7 Drawing Sheets

SIDE ENTRY BATHTUB

This application is a continuation of application Ser. No. 08/178,938, filed Jan. 7, 1994, now abandoned.

BACKGROUND OF THE INVENTION

This invention relates to side entry bathtubs for bathing.

In one class of bathtub, referred to as a side entry bathtub, a closable opening is provided in a side wall of the bathtub to permit entry of a bather when open and to permit filling with water when closed. In some such tubs, a seat is provided for the bather in the tub. In the prior art side entry bathtubs of this class, a hinged door or slideable door is provided in the side of the tub for side entry of a patient and a seat is provided on another side of the tub.

This type of prior art bathtub has several disadvantages, such as: (1) the door does not permit easy entry of personnel for bathing or easy access for cleaning the tub; (2) the seat for the bather is not sufficiently exposed on multiple sides to permit ease in permitting the patient to be placed in the tub; (3) leakage between the side walls of the tub and the door is difficult to control; and (4) the hinges on the door are often a troublesome component in that they may permit leakage or become misaligned or be otherwise too easily damaged.

SUMMARY OF THE INVENTION

Accordingly, it is an object of the invention to provide a novel side entry bathtub.

It is a still further object of the invention to provide a novel approach to sealing side entry tubs.

It is a still further object of the invention to provide a novel apparatus and method for permitting a patient to more easily enter a side entry bathtub.

It is a still further object of the invention to provide a novel apparatus and method for permitting access to a seat positioned in a side entry bathtub.

It is a still further purpose of the invention to provide a sturdy wall in a bathtub which wall opens outwardly to enable a patient to be seated on an attached seat without risking excessive wear on hinges or misalignment of the supporting wall from the weight of the bather.

It is a still further object of the invention to provide a seat for a bather that rotates with a portion of the sides of a side entry bathtub to provide easy access to the seat.

In accordance with the above and further objects of the invention, a side entry bathtub includes a movable section and a fixed section, each of which has a bottom, an open top, three closed sides and one open side. The movable section is pivotable so that: (1) in one position, its open side communicates with the open side of the stationary section, forming a sealed bathtub with a seat or other support for a bather in the tub; and (2) in another position, the seat is fully exposed for seating of a bather and/or an open side is exposed to permit easy entry. In the preferred embodiment, the seat is mounted in the movable portion which pivots about a central mechanism so that the open side and the seat are easily accessible.

To prevent the sealing surfaces between the movable section and the stationary section from undue wear during the movement of the movable section, the center pivot lifts the pivot section before moving it or at the same time as it is moved. A leg rest lifts the bather's legs free from collision while the movable and stationary sections move with respect to each other. The operation may be entirely automatic or partly automatic or entirely manual.

In use, the attendant pivots the movable section, and in the preferred embodiment, the movable section includes a seat for the bather so the bather, seat and movable section all pivot together. When the movable section has pivoted from the closed bathing position to an open position, there is complete access to the patient seat. This may be used for cleaning or for moving the patient in and out of the seat. Before pivoting to and from the open and closed position, a leg rest pivots to a position that moves the bather's legs free from obstructions.

To permit some water to be introduced in the tub before the patient is in position for bathing, the stationary section includes a lower portion that may be filled because the lower portion of the stationary section includes four closed wall portions and a bottom portion joined to form a watertight container and the movable portion seals to the stationary portion higher on the walls. Of course, the movable portion could be lower than the stationary portion and include a container for holding water when the tub is open instead of or in addition to the stationary portion. The tub includes means to provide water and soap and the like and may include indicator lights. Controls may be positioned near the seat.

From the above summary, it can be understood that the side entry bathtub and method of using it of this invention have several advantages, such as: (1) it is relatively leak resistant; (2) it can be partly filled before the patient is seated; (3) upon patient entry or exit, the seat is more fully exposed than other side entry tubs; and (4) it is durable with special provision made for preventing excessive wear on the seals.

SUMMARY OF THE DRAWINGS

The above noted and other features of the invention will be better understood from the following detailed description when considered with reference to the accompanying drawings, in which.

DETAILED DESCRIPTION

Figure 1:
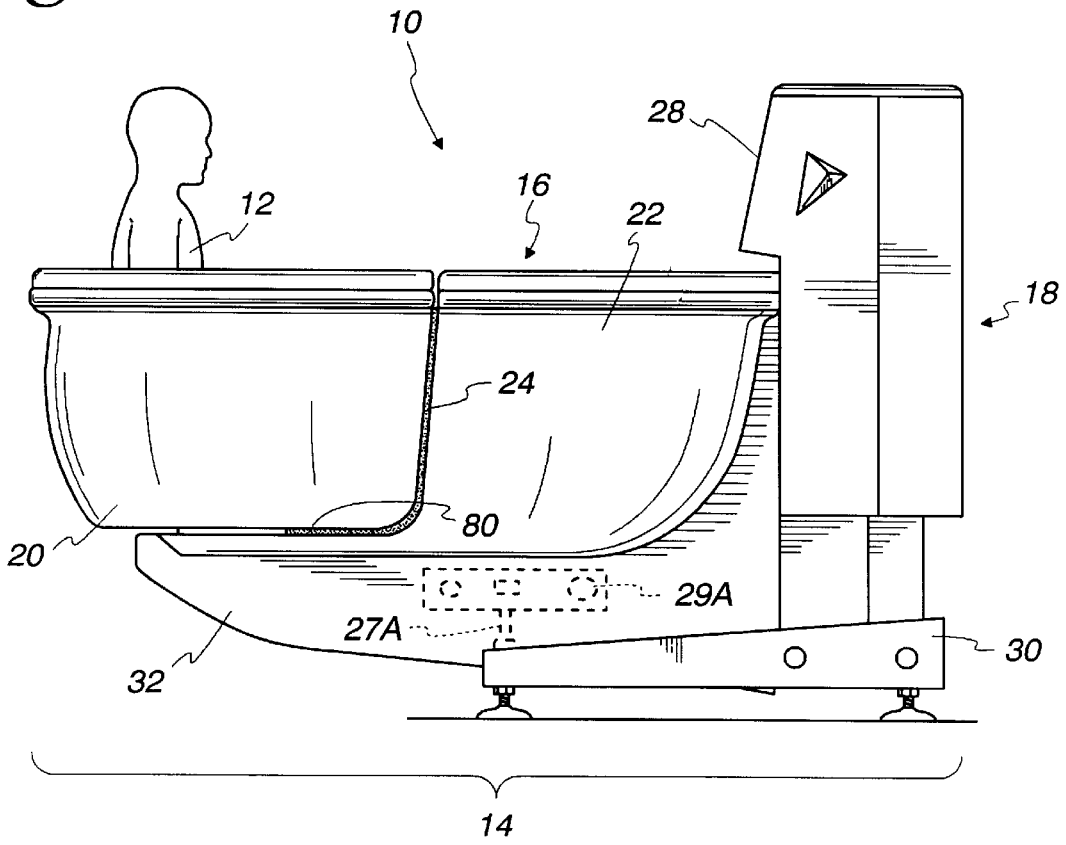
FIG. 1 is a side elevational view of a side entry bathtub in accordance with the invention.

In FIG. 1, there is shown a bathing system 10 and a patient 12 within the bathing system. The bathing system 10 includes a bathtub assembly 16 and a tub operations assembly 18. The bathtub assembly 16 opens and closes the movable section 20 to permit easy entry and exiting of the patient 12 and to expose a chair within the movable assembly.

The tub assembly 16 includes a moving section 20, a stationary section 22 and a tub gasket 24. In the preferred embodiment, the movable section 20 includes a chair for the bather 12. The movable section 20 and the stationary section 22, when in the position shown in FIG. 1, form a tub capable of holding adequate water for bathing, and in another position, permit easy access to the inside of the tub from a side of the tub.

To permit easy access to the bathtub, each of the movable section 20 and stationary section 22 has a different one of three walled sides, a bottom side, an open top and a fourth open side. The fourth open sides of the moving and stationary sections 20 and 22 are sized and positioned to fit together with the fourth sides opening toward each other so that: (1) in one position, the open fourth sides of the two sections communicate with each other to permit the tub to hold water as shown in FIG. 1; and (2) in another position, the open side of the movable section is exposed.

The tub operations assembly 18 includes a control compartment 26, a tub display and control panel 28, a base 30 and a tub bottom stationary support section 32. The display and control panel 28 includes controls for water and soap and indications of temperature and the like. The base 30 supports the control compartment 26 and the tub bottom stationary support section 32 so that, the movable section 20 can be lifted and rotated in a manner to be described hereinafter between an entry position and a bathing position while water can be added in the bathing position and the like either automatically or manually.

To provide sufficient stability for easy sealing between the stationary section 22 and the movable section 20 of the tub assembly 16, a pair of support struts 27A and 27B (27A only being shown in FIG. 1) are mounted directly to the base 30 at a bottom end and to corresponding brackets 29A and 29B (29A being shown in FIG. 1). The brackets 29A and 29B are fastened such as by welded fiber glass to the tub wall of the stationary section to provide support near the center of the tub 22 and away from the control compartment 26 which is fastened at an upper location to the stationary section 22.

The two struts rigidly connect the two parallel legs of the base to both sides of the stationary section 22 and thus substantially eliminate movement of the stationary section 22 as the stationary section is loaded by the weight of water. This stability substantially eliminates relative movement between the movable section 20 and the stationary section 22 in a vertical direction as the tub is filled with water and as the patient enters the tub by holding the stationary section 22 stable. With this stability, the alignment between the stationary section 22 and the movable section 20 when separating or sealing in the closed position may be maintained to as low a value as 10 thousandths of an inch, thus permitting better sealing with a gasket.

With this arrangement, the moving section 20 pivots on the tub bottom stationary support section 32 above the central section of its bottom, lifting slightly, before pivoting so that, when it pivots, the seals, such as the one shown at 24, are not unduly worn by rubbing against mating parts during pivoting. The movable portion 20 pivots to an open position where there is easy access to the stationary section 22 and to the movable section 20 through their open ends.

In the preferred embodiment, the open position permits easy access to the chair both for cleaning and for entering or exiting the tub by the bather 12 because a chair or other support for a patient 12 is built into or fastened to the movable section 20 for motion with it. The control panel 28 is visible to the bather 12 and to an attendant so that the attendant or bather can control the temperature of the water or the filling of the tub or the moving of the movable section 20, if desired. Such control may be manual or automatic.

Figure 2:
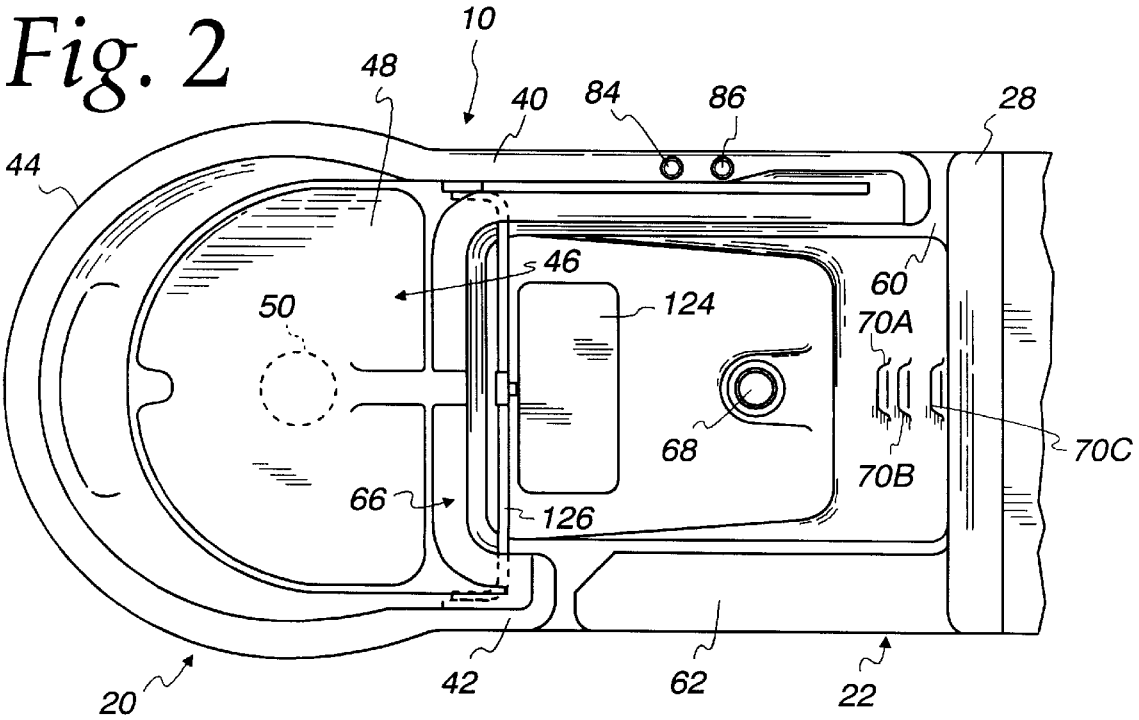
FIG. 2 is a top plan view of a side entry tub in one position in accordance with an embodiment of the invention.

In FIG. 2, there is shown a plan view of the bathing system 10 showing the interior of the movable section 20 and the stationary section 22. As best shown in this figure, the movable section 20 includes a first or left side movable portion 40, a second or right side movable portion 42, a back side movable portion 44 and an open side movable portion 46 rising upwardly from a bottom to form a watertight movable section except for the open side which seals against the open side of the stationary section 22 in the closed position to form a watertight tub. Thus the movable section 20 pivots on a pivot assembly 50 between the open position in which the right side movable portion 42 and a portion of the back side movable portion 44 close the open section of the stationary section 22 and a position where the open side movable portion 46 communicates with an open portion of the stationary section 22.

The stationary section 22 includes a first or left side portion 60, a second or right side portion 62, an end portion 64, an open side 66, a drain 68 and outlet water spigots 70A–70C. Each of the outlet water spigots 70A–70C is at a different level and are used for circulation of liquid to provide a whirlpool effect or to introduce water or to introduce additives such as soap.

The two stationary side portions 60 and 62 and the stationary end portion 64 rise from a bottom portion to form a completely sealed tub together with the movable section 20 when the open side 66 communicates with the open side movable portion 46 of the movable section 20. The combined length of the tub when closed is approximately 54 inches and its total width is 29 inches. The radius of curvature of the outer walls of the end of the movable portion is approximately 16 inches which is substantially the distance between the center of the pivot point and the walls of the stationary section that cooperate with the walls of the movable portion to form a watertight tub.

To lift the bather's legs during movement of the movable section 20 with respect to the stationary section 22 and thus avoid jamming of the legs against the sidewalls of the tub, a leg support 124 is movably mounted to a shaft 126 and adapted to be raised or lowered to lift the bather's legs or to lower the bather's legs. Because the leg support mechanism can move along the shaft 126, it moves with the legs as the movable portion 20 moves with respect to the stationary portion 22. The leg support may move from side to side either by freely sliding under the urging of the bather's leg or by a screw drive through the leg lifting mechanism.

Figure 3:
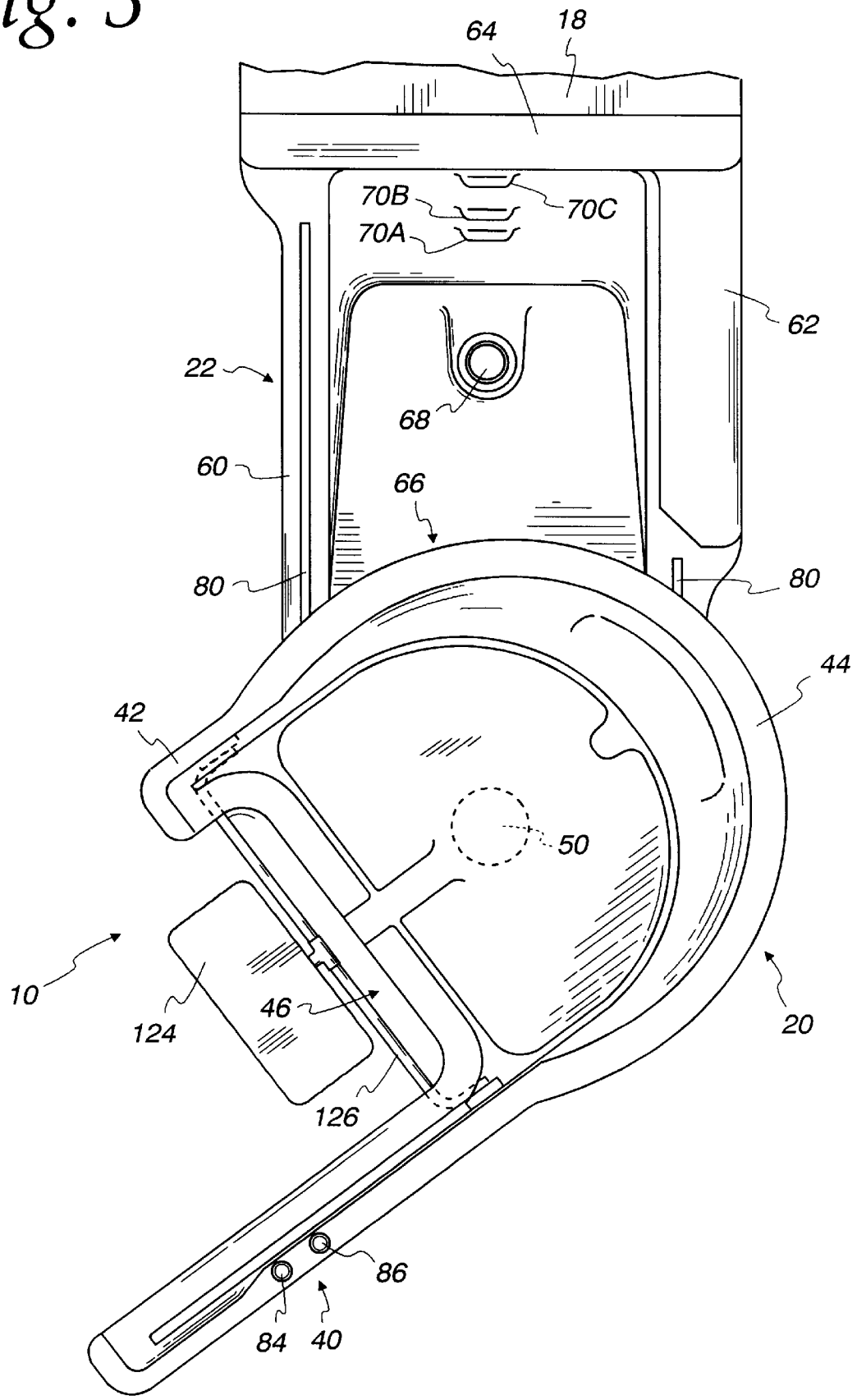
FIG. 3 is a top plan view of the novel side entry tub of FIGS. 1 and 2 shown in another position permitting easy entry of a patient.

In FIG. 3 there is shown a plan view of the bathing system 10 in its entry or open position, with the movable section 20 pivoted about a pivot assembly 50 to expose the chair from the open end of the movable section 20. In this position, a bather may conveniently be assisted into the chair prior to rotation to the closed position of FIG. 2.

As best shown in FIG. 3, right and left horizontal sealing gasket grooves 80 are positioned so that, when the tub is closed, the horizontal surfaces between the moving section 20 and the horizontal section are sealed. There are similar vertical and bottom seals to be described hereinafter to provide complete sealing surfaces and thus render the bathing system 10 watertight and able to hold water when in the position of FIG. 2.

Figure 4:
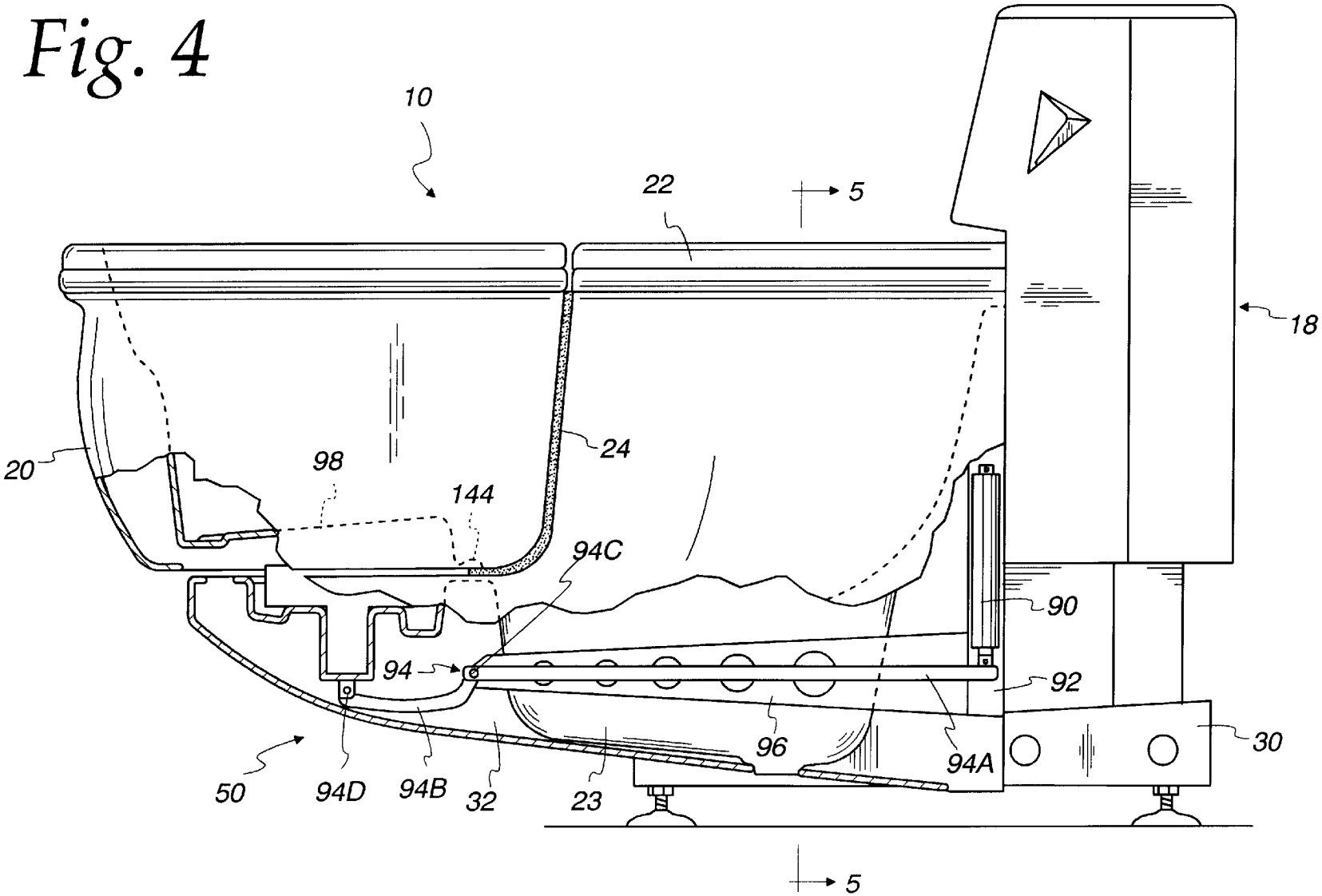
FIG. 4 is a partly broken away side elevational view of the side entry tub of FIGS. 1–3.

In FIG. 4, there is shown a side elevational view of the bathing system 10, partly broken away to show a simplified view of the pivot assembly 50, a portion of the stationary section 22 of the tub, an electrical linear actuator 90, a support arm 92, a bellcrank lever 94 and a support arm 96. The bellcrank lever 94 includes a first section 94A extending from the arm of the electrical linear actuator 90 to a pivot rod or axle 94C that extends between the support arm 96 and parallel support (not shown in FIG. 4). The rod 94C is also connected to the curved length 94B which is connected at its other end to the pivot assembly 50 through a gudgeon or pivot point 94D.

The first section 94A is fastened to the rod 94C at one end of the rod 94C so as to be outside of the stationary section 22 of the tub. The first section 94A turns the rod 94C which extends transverse to the longitudinal axis of the tub from right side to left side. The curved section 94B is also mounted for movement to the rod 94C but at a location aligned with the pivot point 94D such as at a central location thereon so that it moves the pivot point 94D upwardly or downwardly.

The electrical linear actuator 90 is supported by a support arm 92 and connected at the distal end of its piston to one end of the bellcrank lever 94. The pivot rod 94C is transverse to and rotatably mounted on the arm 96 which is rigidly fastened to the frame of the bathing system to provide a stable pivot point at the rod 94C enabling precise movement of the curved length 94B.

In one embodiment, a chair 98 is integrally formed or combinable with the movable section 20 and includes a back rest and a substantially horizontal portion 98 upon which a patient may sit with his or her leg extending in a lower portion of the tub shown at 23. The lower portion of the tub 23 includes the drain and is part of the stationary portion 22. It can be filled even when the movable portion is open to receive a bather.

Figure 5:
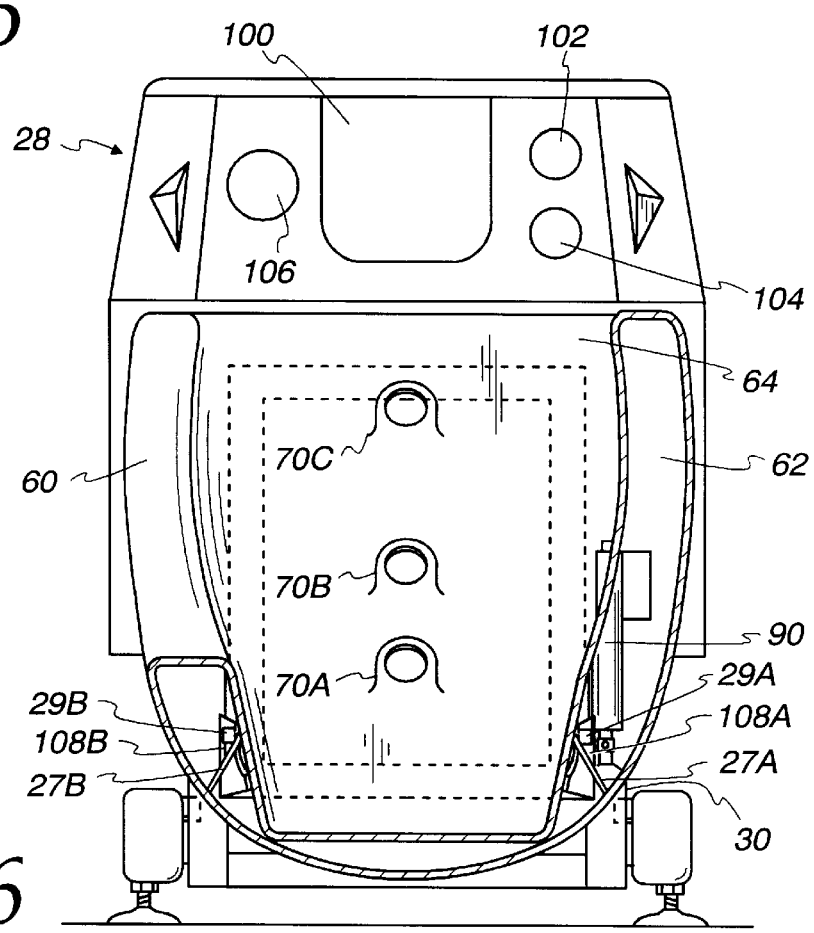
FIG. 5 is an elevational cross sectional view taken through lines 5—5 of FIG. 4.

In FIG. 5, there is shown a sectional elevational view taken through line 5—5 of FIG. 4, showing the control panel 28 on the control compartment 26, the tub openings 70A–70C and the tub wall 60 and 62 and the end 64. The panel includes an indicator section 100, a faucet handle 102, a second faucet handle 104, a disinfectant valve handle 106 and holders 108A and 108B for the tub wall. As shown in this view, the patient can read the indicator section 100 to see indicators and an attendance can control the hot and cold water and disinfectant addition which will be supplied through the spigots or outlets 70A–70C.

As shown in this view, each of the two parallel struts 27A and 27B is mounted to a different one of the two parallel legs of the base 30 and extends upwardly to a corresponding one of the brackets 29A and 29B mounted to the stationary section 22 and to a corresponding one of the sides 60 and 62 respectively of the tub walls. These provide vertical support to avoid excessive bending when weight is placed on the tub such as from water.

Figure 6:
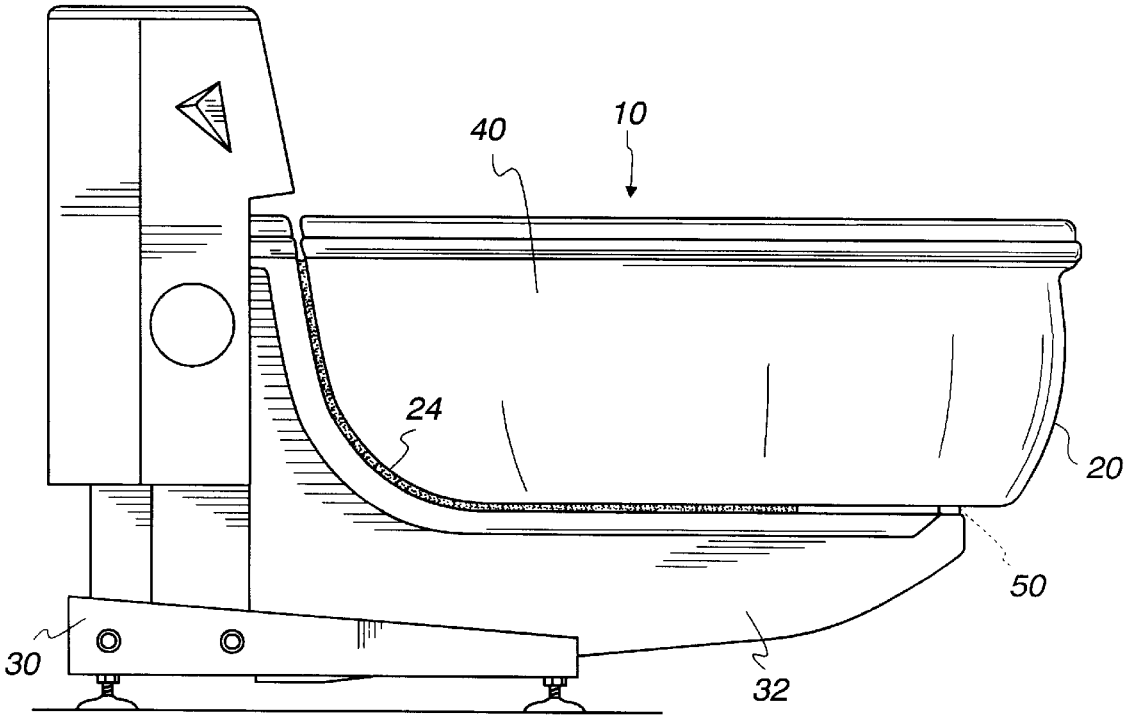
FIG. 6 is a side elevational view of the side entry tub of FIGS. 1–5 in one position.

In FIG. 6, there is shown an elevational view of the bathing system 10 from the left hand side showing the left wall 40 which moves with the movable section 20 and, when in the closed position as shown in FIG. 6, compresses against the gasket 24 to form a seal. The pivot assembly 50 is lowered so that the tub is in the bathing position and can hold a patient within the chair near the end wall of the movable section 20.

Figure 7:
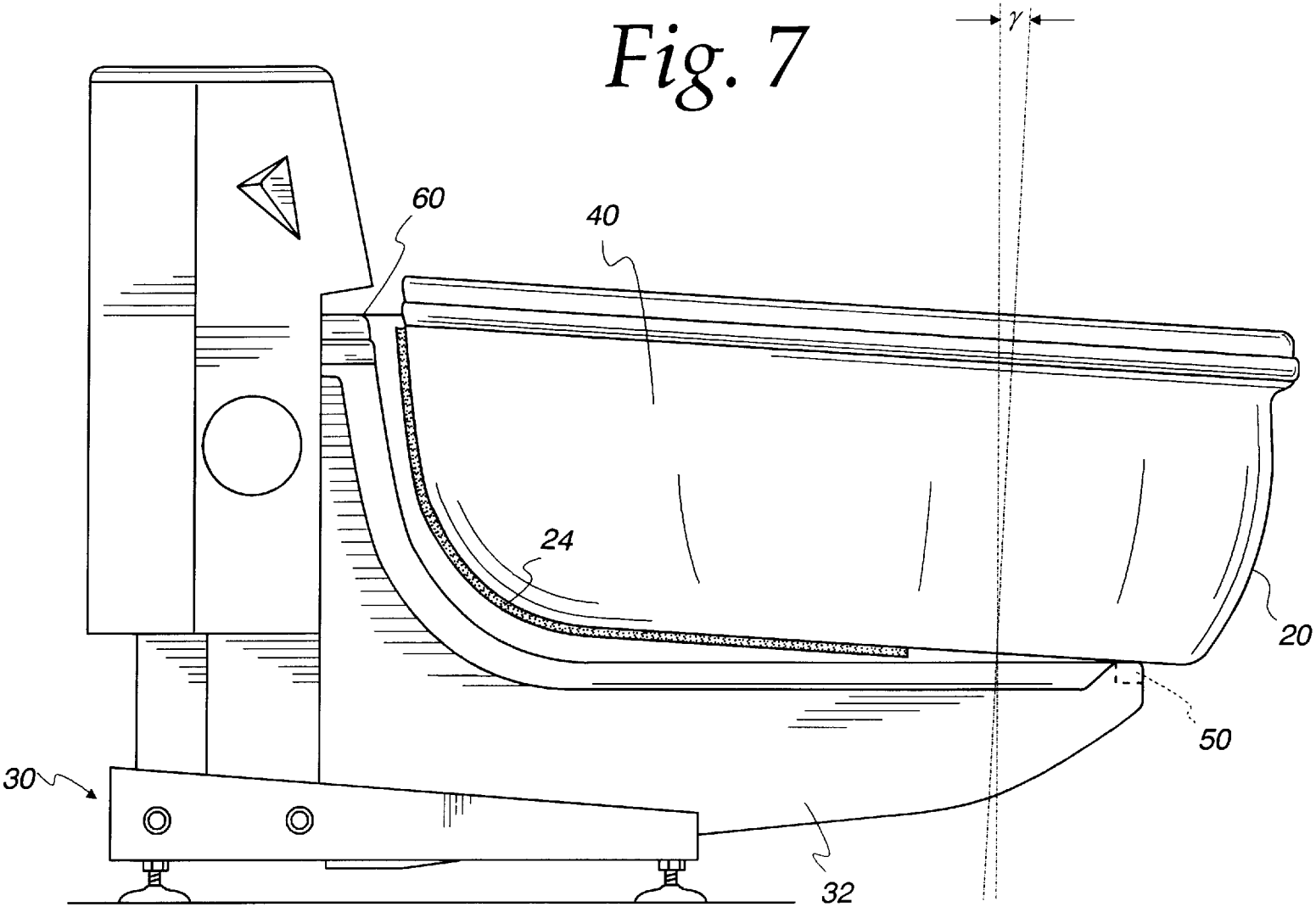
FIG. 7 is a side elevational view of the tub of FIG. 2 in another position.

In FIG. 7, there is shown another elevational view from the left hand side but with the movable section 20 elevated for pivoting so that the gasket 24 and stationary wall 60 are separated from the tub bottom stationary support section 32. In this position, the tub may be opened, and when opening, the wall 40 and gasket 24 do not rub against the stationary wall 60 to cause wear or damage to the gasket 24. Of course the gasket 24 may be on either side of the wall, and in the preferred embodiment, it is mounted to the movable portion 20 and engages the stationary portion 22 rather than being mounted to the stationary portion 22. In the preferred embodiment, the movable portion 20 remains parallel with the tub and rises about 1 inch when about to pivot and then tilts in the opposite direction shown in FIG. 7 by 1 degree and pivots to the open position for the tub.

Figure 8:
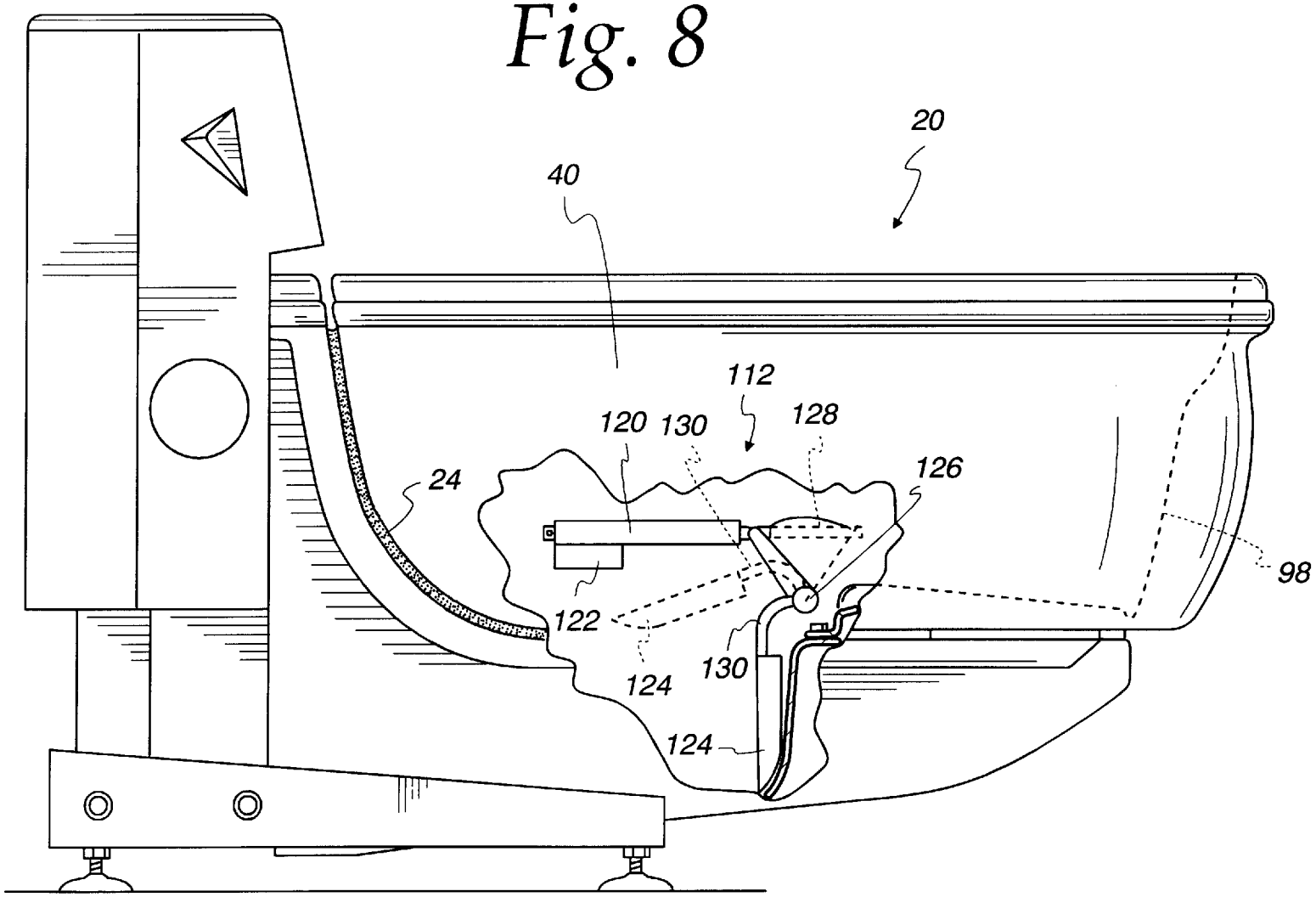
FIG. 8 is a broken away elevational view more particularly disclosing the leg retainer of the embodiment of FIGS. 1–7.

In FIG. 8, there is shown another side elevational view of the movable section 20 with chair 98 partly broken away to show a leg protector at 112 positioned near the chair 98. The leg protector 112 includes as its principal parts an electrical linear actuator 120, a bracket 122, a pivot point 126, a leg support 124, a bellcrank lever 130 and a piston 128. These parts cooperate to lift the legs of a bather above any obstruction as the movable portion of the tub pivots so as to avoid injury to the bather's legs. It may be actuated automatically with the movement of the movable portion or manually.

To protect the legs of a bather, the actuator 120 is mounted to the wall 40 by bracket 122 and extends and retracts the piston 128. The bellcrank lever 130 is pivotally mounted to the end of the piston 128 and pivotally mounted to the pivot point 126 so that when the piston 128 is extended, the leg support 124 is lifted to a substantially horizontal position as shown in hidden lines, and when the piston is retracted, the leg support 124 is moved into a vertical position adjacent and just below the chair 98 to permit the legs of the bather to extend into the tub.

With this arrangement, when the movable section 20 is lifted and pivoted, the legs of the patient are automatically raised and when the patient is in the bathing position or fully in the exit position, the legs are released to return to their natural dangling position. The pivot point 126, bellcrank lever 130 and linear actuator 120 are mounted in a manner similar to the pivot rod 94C, bellcrank lever 94 and linear actuator 90 of FIG. 4 and operate in a similar manner. Other mechanisms, lever arrangements and actuators may of course be used such as for example hydraulic or pneumatic cylinders that may directly move the legs of pivot members without the use of lever arrangements.

Figure 9:
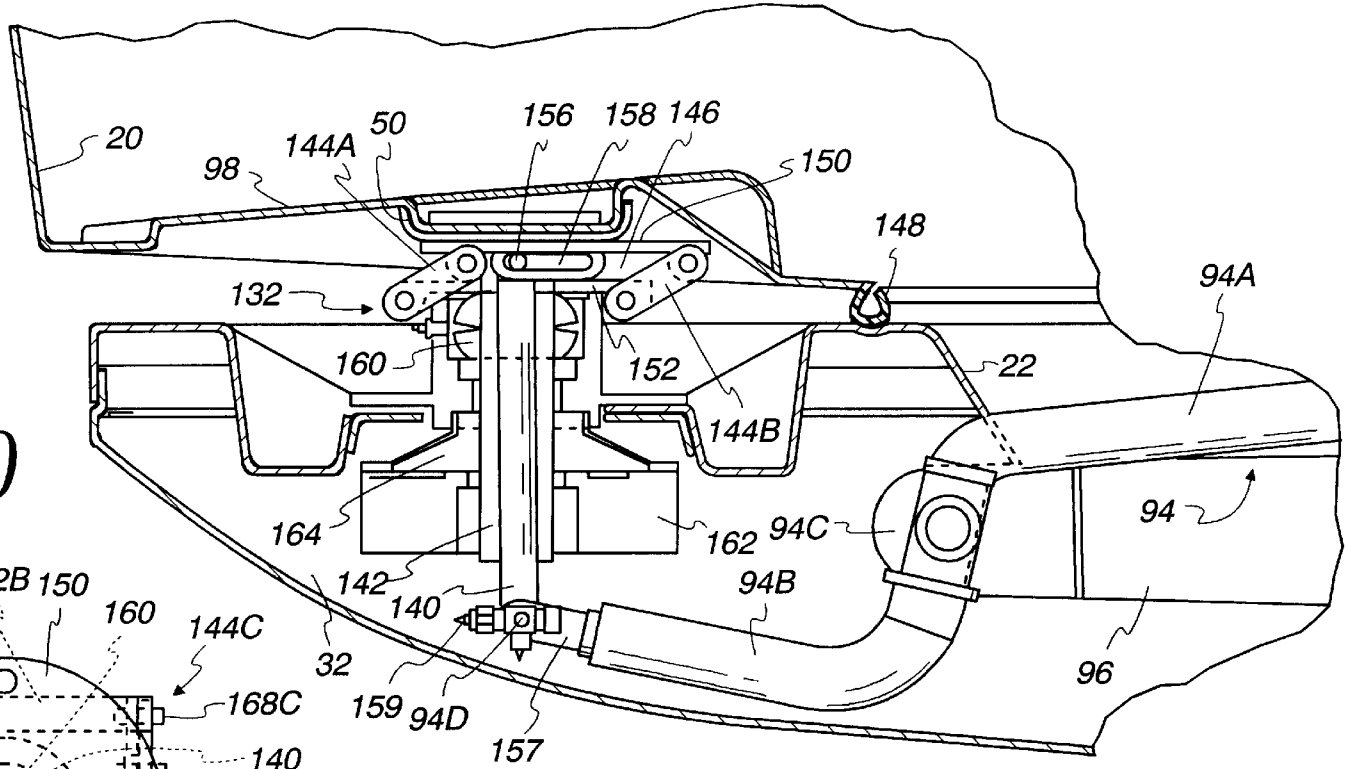
FIG. 9 is a sectional detail view of the mechanism for permitting movement of the side entry tub of FIG. 1.

In FIG. 9 there is shown a sectional view of a portion of the stationary section 22, the tub bottom stationary support section 32, the movable section 20 and a four-bar linkage movably interconnecting the two. The four-bar linkage 132 includes an inner shaft 140, an outer shaft 142, a parallelogram linkage 146 and a seal 148 between the movable section 20 and the stationary section 22. The parallelogram linkage 146 includes an upper plate 150, a lower plate 152, a pin 156, a slot 158 and the four pivot linkages 144A–144D (144A and 144B being shown in FIG. 9).

The clevis is connected at its base to the bellcrank lever section 94 and at its forward end to a spherical bearing 159 which is mounted to an inner shaft 140 to form a universal joint 94D.

With this arrangement, the inner shaft 140 is mounted for rotating motion about its vertical longitudinal axis and for linear motion along its vertical longitudinal axis with respect to the pivot rod 94C and the stationary section 22 in a manner that permits up and down movement of the inner shaft 140 with the end of the bellcrank 94 as well as rotating motion about the spherical bearing 159 and with respect to the outer shaft 142. It is connected at its upper end to the center of a horizontal pin 156.

To cooperate with the longitudinally moving inner shaft 140, an upper plate 150 includes two parallel downwardly-extending ears each of which includes a different one to two parallel horizontal slots that receive the pin 156 so that the pin 156 can move in the slot in a direction parallel to the upper plate 150 and the bottom support as the bottom support and upper plate 150 move vertically toward and away from each other and horizontally with respect to each other with the linkages 144A–144D. In the preferred embodiment, the pin 156 is guided by linear bearings instead of resting in the slot in the downwardly extending ears of the upper plate 150.

The outer shaft 142 is mounted to the lower support 152 of the parallelogram linkage 146 and is movably mounted within the stationary section 22. The inner shaft 140 is movably mounted to the upper plate 150 which in turn is mounted to the bottom of the movable section 20 so as to be linearly and rotatably slidable with the outer shaft 142 and has its lower end mounted for universal action with the bellcrank lever 94 and its upper end in contact with the bottom plate 152 of the parallelogram linkage 146. The inner shaft 140 passes through the center of the bearing 160 and is mounted to the upper plate 150 of the parallelogram linkage 146 so that the inner and outer shafts are movable with respect to the stationary portion 22 of the tub and are able to tilt and pivot the movable portion 20 to exert sealing pressure on both the horizontal gaskets and the vertical gaskets.

The tilting motion of the movable portion 20 with respect to the stationary portion 22 is limited to 1 degree toward the gasket by means of retainer surfaces present in the spherical bearing housing secured to the stationary portion 22 of the bathing system 10. An electromagnetic brake 162 is mounted to the outer shaft 142 by a spider coupling 164 to lock the inner and outer shafts 140 and 142 together and thus prevent rotation of the inner shaft and movement of the movable section 20 of the tub. In the preferred embodiment, the spider is removed and the brace is mounted to the main structure.

Figure 10:
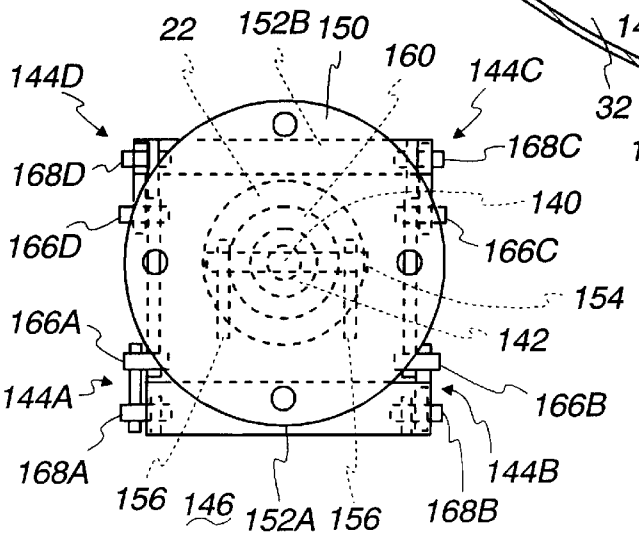
FIG. 10 is a detail view of a portion of the mechanism of FIG. 9.

In FIG. 10, there is shown a plan view of the parallelogram linkage 146 showing the four pivot linkages 144A–144D, each including a different one of the corresponding top plate connectors 166A–166D and corresponding bottom support connectors 168A–168D. Each of the top plate connectors 166A–166D is rotatably connected to the upper plate 150, each of the bottom support connectors 168A and 168B are connected to a lower support 152A and each of the connectors 168C and 168D are connected to the lower support 152B.

The four connector linkages 144A–144D pivot on their connectors so that the parallel upper plate 150 and lower supports 152A–152B may spread apart as the linkages 144A–144D move from a more horizontal orientation to a more vertical orientation. As the linkages 144A–144D change orientation, the parallelogram linkage 146 moves between a low altitude parallelepiped to a right regular parallelepiped, thus changing the distance between the upper plate 150 and the lower supports 152A and 152B and between the movable section 20 and stationary section 22.

Because of the spherical bearings, the movable section 20 is also rotatable about the axis of the vertical inner shaft 140 (FIG. 9) to permit the pivoting of the movable section 20 with respect to the stationary section 22 to open and close the bathtub from the side.

Figure 11:
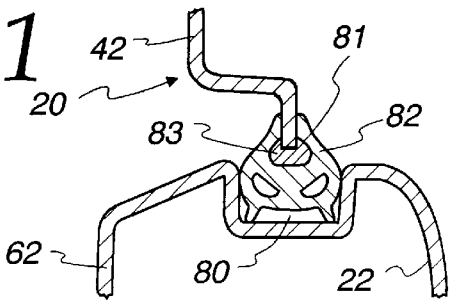
FIG. 11 is a fragmentary sectional view showing a manner of improving the seal of surf aces in the novel side entry tub of FIGS. 1–10.

In FIG. 11, there is shown a fragmentary sectional view of the side walls 42 and 62 on the movable section 20 and stationary section 22 respectively showing the manner in which a seal formed of the groove 80 and a gasket 82 seals the movable section 20 and stationary section 22 together when they are closed. To control the flow of leaking water, one of the two mating walls of the movable section 20 and the stationary section 22 may include a channel 80 to permit the capture and channeling of water. The gasket 82 is provided on the movable wall but may be on the stationary wall for sealing the two together. The combination of the gasket 82 and channel 80 reduce leakage, and in one embodiment, cause the water that is leaking between the mating parts of the walls to be moved to a holding place or moved to a location for more convenient drainage.

The gasket 82 is removably attached to the movable portion 20 to engage or disengage with stationary portion 22 within the groove 80. Upon compression between the wall 42 of the movable portion 20 and the groove 80 of the stationary portion, the gasket 82 expands to seat on three of its sides within the groove 80. Because of the precise alignment obtained from the struts 27A, 27B, the wall 42 is precisely moved so that the gasket 82 aligns within the groove 80 upon closing of the movable section and stationary sections 20 and 22.

The gasket is removably held to the movable portion 20 by second gasket 81 cemented to the wall 42 and sized to fit within a corresponding opening 83 in the gasket 82 with a sealing fit. This connection provides a seal between the wall 42 and the gasket 82 but still permits removal of the gasket 82 from the wall 42 for replacement or the like. The main portion of the gasket 82 includes an angular slot to receive the portion fixed on the end of the wall 42.

In operation, the movable section 20 of the tub may be swung away from the stationary section 22 to expose the chair 98 (FIG. 8) in the position shown in FIG. 3 and thus permit easy cleaning of the chair or entry of a patient. The movable section 20 may then be swung back so that it is in the position shown in FIGS. 1 and 2 with the horizontal seals such as 82 and the vertical seals such as 24 engaged. When swinging in one direction or the other, the movable section 20 is lifted free of the seals by a pivoting action and then clamped back against both vertically and horizontally oriented seals when the tub walls are positioned to hold water.

Before pivoting outwardly, the leg protector 124 (FIG. 8) is moved upwardly to lift the legs of a patient over obstructions. The magnetic brake 162 releases the inner shaft 140 (FIG. 9) to permit movement. The linear actuator 90 moves the shaft 140 upwardly through the bellcrank lever 94 (FIG. 9) tilting the movable section 20 free of the gaskets between the movable and stationary sections and the movable section 20 then pivots on the post 50 to the position shown in FIG. 3.

After closing, the bellcrank lever 94 permits the inner shaft 140 (FIG. 9) to move downwardly under the control of the parallelegram linkage 146 (FIG. 10) which permits the units 144A–144D to move from a substantially vertical position to a substantially horizontal position to lower the movable section 20 onto the stationary section 22 until the seals between the sections are compressed. The stationary section 22 may be partly filled with liquid while the sections are apart and then completely filled after the sections are together and sealed if desired. When the patient is in place, the leg protector 124 is moved downwardly to release the legs and the magnetic brake again fastens. The hot water and disinfectant controls are conventional.

From the above description, it can be understood that the side entry tub of this invention has several advantages, such as: (1) it permits ready access of a chair for a patient to be lifted into place; (2) it permits easy cleaning of a chair section; (3) it permits good sealing of surfaces to each other; (4) it reduces tolerance problems with hinged doors; and (5) it reduces leakage by pivoting about a central location under the tub where liquid may be more readily drained away.

Although a preferred embodiment of the invention has been described with some particularity, many modifications in and variations of the preferred embodiment may be made without deviating from the invention. Therefore, it is to be understood that, within the scope of the appended claims, the invention may be practiced other than as specifically described.

What is claimed is:

1. A bathtub, comprising:

a stationary bathtub portion;

a movable bathtub portion having a seat formed thereon, said movable bathtub portion being movable between an open position in which said movable bathtub portion is not sealed with said stationary bathtub portion and a closed position in which said stationary bathtub portion is sealed with said movable bathtub portion;

a sealing member attached to one of said bathtub portions;

first means for pivoting said movable bathtub portion in a first direction relative to said stationary bathtub portion; and second means for lifting said movable bathtub portion in a second direction relative to said stationary bathtub portion.

2. A bathtub as defined in claim 1 wherein said movable bathtub portion has an approximate center and wherein said pivoting means comprises means for rotating said movable bathtub portion about a substantially vertical axis located at said approximate center of said movable bathtub portion.

3. A bathtub as defined in claim 1 wherein said second means includes means for tilting said movable bathtub portion about a substantially horizontal axis relative to said stationary bathtub portion.

4. A bathtub as defined in claim 1 wherein said sealing member comprises a removable gasket.

5. A bathtub, comprising:

a stationary bathtub portion;

a movable bathtub portion, said movable bathtub portion being movable between an open position in which said movable bathtub portion is not sealed with said stationary bathtub portion and a closed position in which said movable bathtub portion is sealed with said stationary bathtub portion, said movable bathtub portion having a seat;

a movable leg support connected to said movable bathtub portion, said movable leg support adapted to be moved between an extended position and a retracted position, a sealing member attached to one of said bathtub portions;

first means for pivoting said movable bathtub portion about a substantially vertical axis relative to said stationary bathtub portion; and second means for lifting said movable bathtub portion relative to said stationary bathtub portion.

6. A bathtub as defined in claim 5 wherein said second means includes means for tilting said movable bathtub portion about a substantially horizontal axis relative to said stationary bathtub portion.

7. A bathtub as defined in claim 5 wherein said sealing member comprises a removable gasket.

* * * * *